US012680738B2

(12) United States Patent
Long

(10) Patent No.: US 12,680,738 B2
(45) Date of Patent: Jul. 14, 2026

(54) REFRIGERATION SYSTEM

(71) Applicant: Zhigang Long, Beijing (CN)

(72) Inventor: Zhigang Long, Beijing (CN)

( * ) Notice: Subject to any disclaimer, the term of this patent is extended or adjusted under 35 U.S.C. 154(b) by 170 days.

(21) Appl. No.: 18/605,251

(22) Filed: Mar. 14, 2024

(65) Prior Publication Data

US 2024/0310087 A1 Sep. 19, 2024

(30) Foreign Application Priority Data

Mar. 15, 2023 (CN) ..... 202310269445.9

(51) Int. Cl.
*F25B 31/00* (2006.01)
*F25B 31/02* (2006.01)
*F25B 49/02* (2006.01)

(52) U.S. Cl.
CPC ..... *F25B 31/004* (2013.01); *F25B 31/026* (2013.01); *F25B 49/022* (2013.01)

(58) Field of Classification Search
CPC ..... F25B 31/004; F25B 31/026; F25B 49/022
See application file for complete search history.

(56) References Cited

U.S. PATENT DOCUMENTS 5,016,447 A * 5/1991 Lane ..... F25B 43/02 62/473
6,017,205 A * 1/2000 Weatherston ..... F04C 29/02 418/94
2012/0224990 A1 9/2012 Shiibayashi et al.
2019/0309202 A1* 10/2019 Long ..... C09K 5/044

FOREIGN PATENT DOCUMENTS

JP H05172077 A 7/1993

* cited by examiner

*Primary Examiner* — Larry L Furdge
(74) *Attorney, Agent, or Firm* — Bret E. Field; Bozicevic, Field & Francis LLP

(57) ABSTRACT

A refrigeration system includes a scroll compressor, which includes a housing with a low-pressure chamber, and a high-pressure chamber and an oil pool connected thereto, a first condenser, a second condenser and a heat exchange device; the housing is provided with a gas suction port, a liquid-spraying enthalpy increasing port, a first gas exhaust port and a first oil outlet; the first gas exhaust port is connected to the first condenser, one end of-the gas suction port is connected to the scroll compressor and the other end thereof is connected to the heat exchange device; the first oil outlet is connected to an inlet of the second condenser, and an outlet of the second condenser is connected to the liquid-spraying enthalpy increasing port, oil cooled by the second condenser provides cooling for the scroll compressor.

12 Claims, 3 Drawing Sheets

REFRIGERATION SYSTEM

TECHNICAL FIELD

The present application relates to the technical field of a refrigeration device, and in particular to a refrigeration system.

BACKGROUND

In an industrial production, some processes require the use of a refrigeration system to cool a product. During a refrigeration process, due to the high-speed rotation of a scroll compressor, a large amount of heat is generated by the scroll compressor, so that the temperature of the scroll compressor and the exhaust temperature thereof are too high. In order to ensure the normal operation of the refrigeration system, it is necessary to cool the scroll compressor and the exhaust of the scroll compressor. In an existing refrigeration system, the method for cooling the scroll compressor by using refrigerant flowing back to the refrigeration system has a problem of a slow cooling process, which can easily lead to the risk of refrigeration system interruption.

SUMMARY

The purpose of embodiments of the present application is to provide a refrigeration system, which is configured to cool a scroll compressor and exhaust gas of the scroll compressor to ensure the smooth operation of the refrigeration system. The specific technical solutions are as follows.

An embodiment of the present disclosure provides a refrigeration system, which includes: a scroll compressor, a first condenser, a second condenser and a heat exchange device; the scroll compressor includes a housing and a low pressure chamber, a high pressure chamber and an oil pool which are disposed in the housing; wherein the high pressure chamber is connected to the oil pool; the housing is provided with a gas suction port, a liquid-spraying enthalpy increasing port, a first gas exhaust port and a first oil outlet; wherein the first gas exhaust port is configured to be connected to the first condenser, to convey condensed refrigerant to the heat exchange device, one end of the gas suction port is connected to the scroll compressor, and the other end of the gas suction port is connected to the heat exchange device, to absorb refrigerant that flows back after heat exchange by the heat exchange device; the first oil outlet is connected to an inlet of the second condenser, and an outlet of the second condenser is connected to the liquid-spraying enthalpy increasing port, oil cooled by the second condenser provides cooling for the scroll compressor.

An embodiment of the present disclosure provides a refrigeration system, which includes a scroll compressor, a first condenser, a second condenser and a heat exchange device. A low pressure chamber, a high pressure chamber and an oil pool of the scroll compressor are connected with each other, and the refrigerant and oil in the scroll compressor can circulate in the scroll compressor. During the operating process, the scroll compressor can absorb low-temperature and low-pressure refrigerant from the system through the gas suction port, and compress the refrigerant in the scroll compressor, so that the low-temperature and low-pressure gas of refrigerant becomes high-temperature and high-pressure refrigerant, the compressed refrigerant can be discharged through the first gas exhaust port and enter the first condenser, the first condenser condenses the high-temperature and high-pressure refrigerant discharged from the scroll compressor, and the condensed refrigerant enters the heat exchange device for continuing cooling, the refrigerant after heat exchange by the heat exchange device flows back in the refrigeration system and flows back to the scroll compressor through the gas suction port, allowing the refrigerant to circulate in the refrigeration system, so that the refrigeration process can continue. During the operation of the scroll compressor, about 80% of the region below the top of the scroll compressor housing is in a high-temperature and high-pressure state.

Due to high speed operation of the scroll compressor, a large amount of heat is generated during the operation. The first oil outlet on the oil pool of the scroll compressor is connected to the inlet of the second condenser. The high temperature oil in the oil pool can enter the second condenser through the first oil outlet for cooling, and the cooled low-temperature oil can cool the scroll compressor. Using the cooled oil to cool the scroll compressor, compared with using the refrigerant that flows back to cool the scroll compressor, the cooling speed is faster, the time required is shorter, thereby avoiding the case that the temperature within the scroll compressor is too high, causing the scroll compressor to run more smoothly, and extending the service life of the scroll compressor, thereby ensuring the normal operation of the refrigeration system. In addition, cooling the scroll compressor may further lower the temperature of the refrigerant discharged from the scroll compressor and improve the refrigeration effect.

In addition, the refrigeration system according to the embodiment of the present application may further have the following technical features.

In some embodiments, the refrigeration system further includes an oil separator, which is provided between the first condenser and the scroll compressor and is provided with a first gas inlet, a first oil inlet, a second gas exhaust port, a second oil outlet and a third oil outlet; the first gas exhaust port of the housing is connected to the first condenser through the oil separator, the oil separator is configured to receive gas of refrigerant mixed with the oil discharged from the scroll compressor through the first gas inlet; the second gas exhaust port of the oil separator is connected to the first condenser, to discharge separated gas containing refrigerant to the first condenser, so that the first condenser condenses the gas and conveys it to the heat exchange device for heat exchange; the first oil outlet of the housing is connected to the first oil inlet of the oil separator, to maintain a stable liquid level in the oil pool; the liquid-spraying enthalpy increasing port of the housing is connected to the second condenser through the oil separator, and then connected to the second oil outlet to cause the oil in the oil separator to flow back into the scroll compressor through the liquid-spraying enthalpy increasing port, so as to cool the scroll compressor; the third oil outlet is configured to discharge excessive oil and gas of refrigerant in the oil separator to convey them into the heat exchange device; a horizontal position of the third oil outlet (25) is higher than horizontal positions of the first oil inlet and the second oil outlet of the oil separator.

In some embodiments, a solenoid valve is provided between the second oil outlet and the liquid-spraying enthalpy increasing port, and is closed when the compressor stops operation.

In some embodiments, a float switch is provided in the oil separator, and when a liquid level in the oil separator is higher than that of the oil pool, the float switch opens the third oil outlet; when the liquid level in the oil separator is equal to or lower than that of the oil pool, the float switch closes the third oil outlet.

In some embodiments, the refrigeration system further includes a throttling device disposed between the third oil outlet and a subsequent-stage heat exchanger, when a liquid level in the oil separator is higher than that of the oil pool, a pressure difference between the oil separator and the throttling device causes the excessive oil and refrigerant to be discharged through the third oil outlet.

In some embodiments, the heat exchange device includes N-stage heat exchangers and an evaporator, N is greater than or equal to 2, and the N-stage heat exchangers are connected in series, and each of the N-stage heat exchangers includes a liquid inlet, a second gas inlet, a gas outlet and a liquid outlet, the liquid inlet and the gas outlet are connected between heat exchangers at every two adjacent stages, and the liquid outlet and the second gas inlet are connected between the heat exchangers at every two adjacent stages through a gas-liquid separator, and the third oil outlet is connected to the liquid inlet of the second-stage heat exchanger through a pipeline, a liquid outlet of an Nth-stage heat exchanger is connected to an inlet of the evaporator, and an outlet of the evaporator is connected to a liquid inlet of an (N−1)th-stage heat exchanger.

In some embodiments, the refrigeration system further includes a first temperature sensor and a second temperature sensor, and the first temperature sensor is disposed at the gas outlet of the Nth-stage heat exchanger; the second temperature sensor is disposed at an outlet pipeline of the evaporator; the scroll compressor is a variable frequency scroll compressor; the refrigeration system further includes a control system that: when in a pre-cooling state, controls the first temperature sensor to collect the temperature of the refrigerant between the liquid inlet and the gas outlet in the Nth-stage heat exchanger in real time; and reduces an operating frequency of the scroll compressor when the temperature collected by first temperature sensor reaches a first preset temperature; and when in a refrigeration operating state, controls the second temperature sensor to collect the temperature of the refrigerant output from the evaporator in real time, and reduces the operating frequency of the scroll compressor when the temperature collected by the second temperature sensor reaches a second preset temperature.

BRIEF DESCRIPTION OF THE DRAWINGS

In order to more clearly describe the technical solutions of the embodiments of the application and the prior art, accompanying drawings that need to be used in the embodiments and the prior art will be briefly described below. Obviously, accompanying drawings described below are for only some of embodiments of the application. Those skilled in the art may also obtain other embodiments based on these accompanying drawings.

Figure 1:
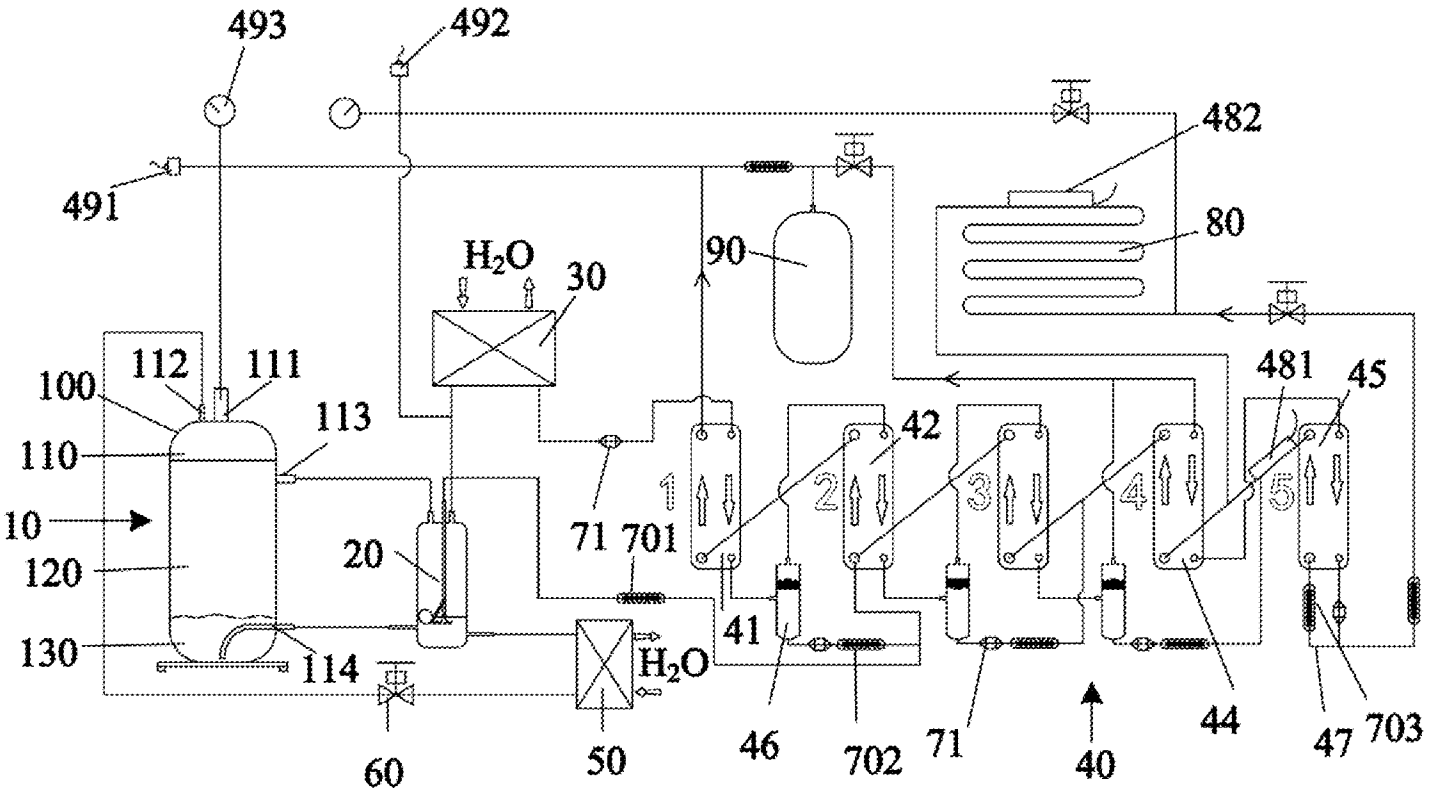
FIG. 1 is a schematic diagram showing the connection of a refrigeration system provided by an embodiment of the present application.

Reference signs are as follows:

Scroll compressor 10; oil separator 20; first condenser 30; heat exchange device 40; second condenser 50; housing 100; low pressure chamber 110; high pressure chamber 120; oil pool 130; gas suction port 111; liquid-spraying enthalpy increasing port 112; first gas exhaust port 113; first oil outlet 114; first gas inlet 21; second gas exhaust port 22; first oil inlet 23; second oil outlet 24; third oil outlet 25; solenoid valve 60; float 210; moving ejection pin 220; long tube 230; first throttling device 701; second throttling device 702; third throttling device 703; filter 71; first-stage heat exchanger 41; second-stage heat exchanger 42; fourth-stage heat exchanger 44; fifth-stage heat exchanger 45; evaporator 80; second gas inlet 411; liquid outlet 412; gas outlet 413; liquid inlet 414; gas-liquid separator 46; bypass 47; first temperature sensor 481; second temperature sensor 482; first pressure sensor 491; second pressure sensor 492; pressure gauge 493; buffer tank 90.

DETAILED DESCRIPTION

The technical solutions in the embodiments of the present application will be clearly and completely described below with reference to the accompanying drawings in the embodiments of the present application. Obviously, the described embodiments are only some, and not all, of the embodiments of the application. All other embodiments obtained based on the embodiments of the application by those skilled in the art fall into the scope of protection of the application.

It is to be understood that the terms in the disclosure are for the purpose of describing particular embodiments merely and are not intended to limit the disclosure. The singular forms "a", "an" and "the" are intended to include the plural forms as well, unless the context clearly dictates otherwise. The terms "comprise", "include", "contain" and "have" are inclusive, and thus indicate the presence of stated features, steps, operations, elements and/or parts but do not exclude the presence or addition of one or various other features, steps, operations, elements, components, and/or combinations thereof. The method steps, processes, and operations described herein are not to be construed as requiring that they be performed in the particular order described or illustrated, unless the order of performance is expressly indicated. It should also be understood that additional or alternative steps may be used.

Although the terms first, second, third, etc. may be used herein to describe various elements, components, regions, layers and/or sections, these elements, components, regions, layers and/or sections shall not be referred to as restricted by these terms. These terms are only used to distinguish one element, component, region, layer or section from another region, layer or section. Terms such as "first", "second" and other numerical terms when used herein do not imply a sequence or order unless clearly indicated in the context. Thus, a first element, component, region, layer or section discussed below could be termed a second element, component, region, layer or section without departing from the teachings of the illustrative embodiments.

For convenience of description, spatially relative terms may be used herein to describe the relationship of one element or feature to another element or feature as shown in the figures. These relative terms, such as "inner", "outer", "inside", "outside", "below", "beneath", "above", "over", etc. . . . Such spatially relative terms are intended to encompass different orientations of the device in use or operation in addition to the orientation depicted in the figures. For example, if the device in the figures is turned over, elements described as "below" or "beneath" other elements or features would then be oriented "above" or "over" other elements or features. Thus, the example term "beneath" may include an orientation of above and below. The device may be otherwise oriented, for example rotated 90 degrees or at other orientations and interpreted by the spatially relative descriptors used herein accordingly.

As shown in FIGS. 1 to 4, an embodiment of the present disclosure provides a refrigeration system, which includes: a scroll compressor 10, a first condenser 30, a second condenser 50 and a heat exchange device 40. The scroll compressor 10 includes a housing 100, and a low pressure chamber 110, a high pressure chamber 120 and an oil pool 130 which are disposed in the housing 100. The high pressure chamber 120 is connected to the oil pool 130. The housing 100 is provided with a gas suction port 111 and a liquid-spraying enthalpy increasing port 112, a first gas exhaust port 113 and a first oil outlet 114. The first gas exhaust port 113 is configured to connect to the first condenser 30 to convey condensed refrigerant to the heat exchange device 40, and one end of the gas suction port 111 is connected to the scroll compressor 10, and the other end of the gas suction port 111 is connected to the heat exchange device 40, to absorb the refrigerant that flows back after heat exchange by the heat exchange device 40. The first oil outlet 114 is connected to an inlet of the second condenser 50, an outlet of the second condenser 50 is connected to the liquid-spraying enthalpy increasing port 112, and oil cooled by the second condenser 50 provides cooling for the scroll compressor 10.

The embodiment of the present disclosure provides a refrigeration system, which includes a scroll compressor 10, a first condenser 30, a second condenser 50 and a heat exchange device 40. The low pressure chamber 110, the high pressure chamber 120 and the oil pool 130 of the scroll compressor 10 are connected with each other, and refrigerant and oil in the scroll compressor 10 can circulate in the scroll compressor 10. During operation, the scroll compressor 10 can absorb low-temperature and low-pressure refrigerant from the system through the gas suction port 111, and compress the refrigerant in the scroll compressor 10, so that the low-temperature and low-pressure gas of refrigerant becomes high-temperature and high-pressure refrigerant. The compressed refrigerant can be discharged through the first gas exhaust port 113 and enter the first condenser 30. The first condenser 30 condenses the high-temperature and high-pressure refrigerant discharged from the scroll compressor 10 according to the actual needs in the subsequent heat exchange device 40, and the condensed refrigerant enters the heat exchange device 40 to continue cooling, the refrigerant after heat exchange through the heat exchange device 40 flows back in the refrigeration system and flows back to the scroll compressor 10 through the gas suction port 111, so that the refrigerant circulates in the refrigeration system, and thereby the refrigeration process continues. During the operation of the scroll compressor 10, the outside of the housing 100 of the scroll compressor 10 is in a high temperature state, and the inside of the high pressure chamber 120 is in a high pressure state.

Due to high speed operation of the scroll compressor 10, a large amount of heat is generated during the operation. The first oil outlet 114 on the oil pool 130 of the scroll compressor 10 is connected to the inlet of the second condenser 50. The high temperature oil in the oil pool 130 can enter the second condenser 50 through the first oil outlet 114 for cooling, and the cooled low-temperature oil can cool the scroll compressor 10. Using the cooled oil to cool the scroll compressor 10, compared with using the refrigerant that flows back to cool the scroll compressor 10, the cooling speed is faster, the time required is shorter, thereby avoiding the case that the temperature within the scroll compressor 10 is too high, causing the scroll compressor 10 to run more smoothly, and extending the service life of the scroll compressor 10, thereby ensuring the normal operation of the refrigeration system. In addition, cooling the scroll compressor 10 may further lower the temperature of the refrigerant discharged from the scroll compressor 10 and improve the refrigeration effect.

Specifically, the present application uses a single scroll compressor refrigeration system, which can achieve the refrigeration temperature between −60° C. and −160° C. The type of the scroll compressor used is a scroll compressor with a high pressure chamber 120, and the pressure within the low pressure chamber 110 is lower than that within the high pressure chamber 120. Compared with a butterfly valve compressor used in the refrigeration system in the prior art, the scroll compressor can withstand larger suction and higher exhaust temperature in the refrigeration system.

Specifically, refrigerant, also referred to as coolant, is medium substance used to complete energy conversion in a refrigeration device, the refrigerant in an auto-cascade refrigeration system is a composite refrigerant, which is usually a mixture of more than five refrigerants. In the embodiment of the present application, a first type of refrigerant may be argon or nitrogen gas, a second type of refrigerant may be methane or krypton, a third type of refrigerant may be tetrafluoromethane, a fourth type of refrigerant may be trifluoromethane or fluoromethane, a fifth type of refrigerant can be hexafluoropropylene, pentafluoropropylene, and a be sixth type of refrigerant can monochlorotrifluoropropene and hexafluoro-2-butene, the above refrigerants are non-toxic and non-flammable, thereby improving the safety of the refrigeration system.

Specifically, the first condenser 30 can be cooled by water cooling or air cooling, preferably, since water cooling has a better cooling effect, in the embodiment of the present application, water is selected as the heat exchange medium of the first condenser 30, similarly, the heat exchange medium of the second condenser 50 is also water.

Specifically, the first gas exhaust port 113 may be orientated on the housing 100 perpendicularly to the direction of the longitudinal section of the scroll compressor 10.

Specifically, as shown in FIG. 1, a filter 71 may be provided between the first condenser 30 and the heat exchange device 40, to filter out impurities in the refrigerant and prevent clogging of the refrigeration pipeline.

Figure 2:
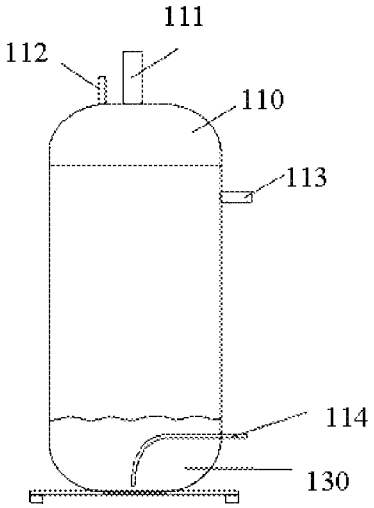
FIG. 2 is a schematic structural diagram of a scroll compressor provided by an embodiment of the present application.
Figure 3:
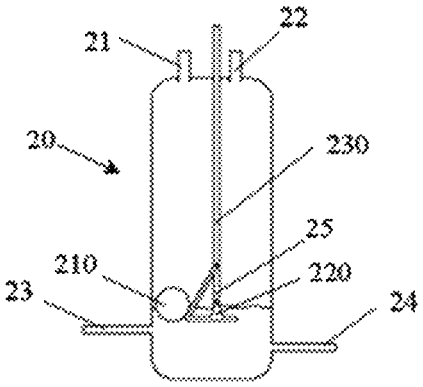
FIG. 3 is a schematic structural diagram of an oil separator provided by an embodiment of the present application.

In some embodiments of the present application, as shown in FIGS. 1, 2 and 3, the refrigeration system further includes an oil separator 20, which is provided between the first condenser 30 and the scroll compressor 10 and is provided with a first gas inlet 21, a first oil inlet 23, a second gas exhaust port 22, a second oil outlet 24 and a third oil outlet 25. The first gas exhaust port 113 of the housing 100 is connected to the first condenser 30 through the oil separator 20, which is configured to receive gas of refrigerant mixed with oil discharged from the scroll compressor 10 through the first gas inlet 21. The second gas exhaust port 22 of the oil separator 20 is connected to the first condenser 30, to discharge separated gas containing the refrigerant to the first condenser 30, so that the first condenser 30 condenses the gas and conveys it to the heat exchange device 40 for heat exchange. The first oil outlet 114 of the housing 100 is connected to the first oil inlet 23 of the oil separator 20, to maintain a stable liquid level in the oil pool 130. The liquid-spraying enthalpy increasing port 112 of the housing 100 is connected to the second condenser 50 through the oil separator 20, and then connected to the second oil outlet 24, to cause the oil in the oil separator 20 to flow back into the scroll compressor 10 through the liquid-spraying enthalpy increasing port 112, so as to cool the scroll compressor 10. The third oil outlet 25 is configured to discharge excessive oil and gas of refrigerant in the oil separator 20 to convey them into the heat exchange device 40. The horizontal position of the third oil outlet 25 is higher than horizontal positions of the first oil inlet 23 and the second oil outlet 24 of the oil separator 20.

In the embodiment of the present application, the high-temperature and high-pressure refrigerant compressed by the scroll compressor 10 is discharged from the scroll compressor 10 through the first gas exhaust port 113, and enters the oil separator 20 through the first gas inlet 21.

During the compression process, some refrigerants with a higher boiling point liquefy and settle in the oil pool 130, and are miscible with the oil in the scroll compressor 10. The first oil inlet 23 is connected to the first oil outlet 114 so that the oil mixed with high boiling point refrigerant in the scroll compressor 10 and the oil in the oil separator 20 can circulate with each other, and the minimum oil level of the scroll compressor 10 can be controlled to be not lower than the oil level in the oil separator 20 by controlling the oil level within the oil separator 20, which can avoid the risk of oil shortage during the operation of the scroll compressor 10 and stabilize the oil level of the scroll compressor 10, thereby causing the scroll compressor 10 to run more smoothly and ensuring the normal operation of the refrigeration system.

The gas of refrigerant mixed with oil can be separated into gas of refrigerant and oil in the oil separator 20, the separated oil settles to the bottom of the oil separator 20 and is mixed with oil present in the oil separator 20, and then is discharged through the second oil outlet 24. Under the action of pressure, mixed liquid of the oil and high boiling point refrigerant in the oil separator 20 is conveyed to the liquid-spraying enthalpy increasing port 112 of the scroll compressor 10. The gas separated in the oil separator 20 is discharged through the second gas exhaust port 22 and enters the first condenser 30, the gaseous refrigerant discharged from the second gas exhaust port 22 has a higher temperature, and the first condenser 30 can cool the refrigerant according to the actual needs in the subsequent heat exchange device 40.

Further, in the vertical direction of the oil separator 20, the second oil outlet 24 of the oil separator 20 is lower than the first oil inlet 23.

During the refrigeration process, since the high boiling point refrigerant mixed with the oil continuously flows into the oil separator 20, a part of the high boiling point refrigerant cannot flow into the subsequent heat exchange device 40, and thus cannot play the role of the high boiling point refrigerant. Therefore, the oil separator 20 is provided with a third oil outlet 25, which is mainly configured to discharge the high boiling point refrigerant in the oil separator 20 into the subsequent-stage heat exchange device 40 to be effective.

Since the oil discharged from the scroll compressor 10 can be separated by the oil separator 20 and flow back into the scroll compressor 10, the oil vaporized due to high temperature in the scroll compressor 10 can be condensed and flow back into the scroll compressor 10, to continue to operate in the scroll compressor 10, and the oil discharged from the scroll compressor 10 is recycled, thereby saving costs.

As shown in FIGS. 1 and 2, in some embodiments of the present application, a solenoid valve 60 is provided between the second oil outlet 24 and the liquid-spraying enthalpy increasing port 112, and is closed when the scroll compressor 10 stops operation.

As shown in FIG. 1, in the embodiment of the present application, a liquid-spraying enthalpy increasing port 112 is provided on the housing 100 of the scroll compressor 10. The refrigerant and oil in the oil separator 20 can enter the scroll compressor 10 through the second oil outlet 24 and the liquid-spraying enthalpy increasing port 112, thereby cooling the scroll compressor 10. The solenoid valve 60 between the liquid-spraying enthalpy increasing port 112 and the scroll compressor 10 can cut off a pipeline entering the scroll compressor 10 from the liquid-spraying enthalpy increasing port 112 after the scroll compressor 10 is stopped, thereby avoiding a large amount of oil at the bottom of the scroll compressor 10 is absorbed into the low pressure chamber 110 through the liquid-spraying enthalpy increasing port 112, causing the scroll plate of the scroll compressor 10 to be damaged due to lack of oil when the scroll compressor 10 is started again, thereby ensuring that the refrigeration system can operate normally.

In some embodiments of the present application, as shown in FIG. 3, a float switch is provided in the oil separator 20. When the liquid level in the oil separator 20 is higher than that of the oil pool 130, the float switch opens the third oil outlet 25, and when the liquid level in the oil separator 20 is equal to or lower than that of the oil pool 130, the float switch closes the third oil outlet 25.

In the embodiment of the present application, the oil in the oil separator 20 may be deposited too much, causing its oil level to exceed the oil level in the oil pool 130 of the scroll compressor 10. In order to maintain a stable oil level in the scroll compressor 10, and to maintain the smooth operation of the scroll compressor 10, a third oil outlet 25 is provided inside the oil separator 20 to discharge excessive oil in the oil separator 20, so that the oil level in the oil separator 20 is basically equal to that in the oil pool 130 of the scroll compressor 10. The third oil outlet 25 is provided with a float switch, when the oil level in the oil separator 20 is too high, the float 210 floats up to open a passage of the third oil outlet 25, when the oil level in the oil separator 20 is equal to that in the scroll compressor 10, the float 210 sinks, and the float switch blocks the third oil outlet 25. Compared with other devices for controlling liquid level, the float switch has a simpler structure and lower cost, and can control the oil level in the oil separator 20 more stably.

Specifically, as shown in FIG. 3, the float switch is composed of a float 210, a moving ejection pin 220 and a long tube 230, wherein the float 210 floats on the oil surface and moves up or down according to the position of the oil surface. The moving ejection pin 220 is in the form of an inverted V-shape, and is located at one end of the V-shape and can block a lower-end inlet of the long tube 230, the lower-end inlet of the long tube 230 can be the third oil outlet 25, the height of which determines the liquid level of the oil pool 130 in the compressor. The oil output from the third oil outlet 25 relies on the liquid hydrostatic pressure between the oil pool 130 and the third oil outlet 25. When the liquid level of the oil pool 130 is equal to the height of the third oil outlet 25, that is, there is no hydrostatic pressure, so the third oil outlet 25 stops discharging oil. Therefore, by controlling the height of the third oil outlet 25, the liquid level in the oil pool 130 can be maintained at a constant position. The long tube 230 is fixed on a bottle body of the oil separator 20, the moving ejection pin 220 can move up and down in the long tube 230, the bottom of the long tube 230 can be aligned with the first oil inlet 23 of the oil separator 20, when the oil level rises, the float 210 floats up along the moving ejection pin 220, applying a downward force to the moving ejection pin 220, causing the moving ejection pin 220 to move downward and leave the bottom of the long tube 230, thereby exposing the third oil outlet 25, and allowing the oil in the oil separator 20 to be discharged from the third oil outlet 25.

In some embodiments of the present application, the refrigeration system as shown in FIG. 1 further includes a first throttling device 701 provided between the third oil outlet 25 and a subsequent-stage heat exchanger. When the liquid level in the oil separator 20 is higher than that of the oil pool 130, a pressure difference between the oil separator 20 and the first throttling device 701 causes excessive oil and refrigerant to be discharged through the third oil outlet 25.

In the embodiment of the present application, the oil level in the oil separator 20 can be controlled by the first throttling device 701, thereby controlling the oil level in the scroll compressor 10. The first throttling device 701 can play the role of the above float switch, as long as the liquid level in the oil separator 20 is higher than the third oil outlet 25, there will be a hydrostatic pressure difference between the oil separator 20 and the third oil outlet 25, and the hydrostatic pressure difference can lead to the discharge of excessive oil and refrigerant through the third oil outlet 25. As the refrigeration system continues to operate, the oil level in the oil separator 20 continues to rise, causing excessive oil and high boiling point liquid refrigerant to accumulate in the oil separator 20. In order to maintain a stable oil level in the scroll compressor 10, it is necessary to discharge the excessive oil and refrigerant. The throttling device is one of the important components in the refrigeration system, and can form a local contraction for the flow of the oil in the pipeline between the third oil outlet 25 and the subsequent-stage heat exchange device 40, thereby accelerating the flow rate of the oil and reducing the hydrostatic pressure, thereby generating a hydrostatic pressure difference before and after the throttling device. Under the action of the pressure difference, the excessive oil and high boiling point refrigerant in the oil separator 20 are discharged from the third oil outlet 25.

Specifically, the first throttling device 701 can be a throttling device such as a capillary tube, an electronic expansion valve, a throttling valve, etc., preferably, a capillary tube is used as the first throttling device 701, the capillary tube is the simplest throttling device with a low production cost, which is beneficial for reducing the operating cost of the entire refrigeration system, and the capillary tube has no moving parts and is not prone to failure or leakage. Therefore, it can reduce the risk of oil leakage in the capillary tube, thereby improving the smooth operation of the refrigeration system.

It should be noted that the above float switch and the first throttling device 701 may be provided simultaneously or separately.

Figure 4:
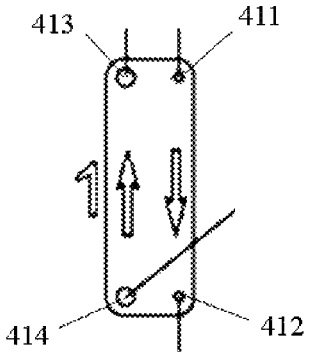
FIG. 4 is an enlarged schematic diagram of a heat exchanger provided by an embodiment of the present application.

In some embodiments of the present application, as shown in FIGS. 1 and 4, the heat exchange device 40 includes N-stage heat exchangers and an evaporator 80, N is greater than or equal to 2, and the N-stage heat exchangers are connected in series. Each of the N-stage heat exchangers includes a liquid inlet 414, a second gas inlet 411, a gas outlet 413 and a liquid outlet 412, wherein the liquid inlet 414 and the gas outlet 413 are connected between heat exchangers at every two adjacent stages, the liquid outlet 412 and the second gas inlet 411 are connected between heat exchangers at every two adjacent stages through a gas-liquid separator 46, the third oil outlet 25 is connected to the liquid inlet 414 of a second-stage heat exchanger 42, the liquid outlet 412 of a Nth-stage heat exchanger is connected to the inlet of the evaporator 80, and the outlet of the evaporator 80 is connected to the liquid inlet 414 of the (N−1)th-stage heat exchanger.

In the embodiment of the present application, the more stages of heat exchange in the refrigeration system, the lower the refrigeration temperature. In a deep cryogenic water vapor supplementary pump and some devices that require low-temperature refrigeration, heat exchangers of 4 to 6 stages are often used. Taking heat exchangers of five stages as an example, the evaporator 80 is one of the important parts in the refrigeration system, provided with an inlet and an outlet, the liquid outlet 412 of the fifth-stage heat exchanger 45 is connected to the inlet of the evaporator 80, the refrigerant that has been subject to a five-stage heat exchange enters the evaporator 80 through the liquid outlet 412 of the fifth-stage heat exchanger 45.

As shown in FIG. 1, in the embodiment of the present application, the liquid inlet 414 and the gas outlet 413 are connected between heat exchangers at adjacent two stages, and the liquid outlet 412 and the second gas inlet 411 are connected between heat exchangers at every two adjacent stages through the gas-liquid separator 46. For example, the liquid inlet 414 of a first-stage heat exchanger 41 is connected to the gas outlet 413 of a second-stage heat exchanger 42, and the liquid outlet 412 of the first-stage heat exchanger 41 is connected to the second gas outlet 411 of the second-stage heat exchanger 42, allowing refrigerant to flow between the five-stage heat exchangers. The gas-liquid separator 46 performs gas-liquid separation on the mixed refrigerant flowing out of each-stage heat exchanger. For example, the gas and liquid mixed refrigerant flowing out from the liquid outlet 412 of the first-stage heat exchanger 41 is separated by the gas-liquid separator 46, and the separated gaseous refrigerant flows into the second-stage heat exchanger 42 from the second gas inlet 411 of the second-stage heat exchanger 42, the gaseous refrigerant releases heat in the heat exchanger, and the gaseous refrigerant with a higher boiling point in the mixed refrigerant is liquefied in the heat exchanger; the liquid refrigerant separated by the gas-liquid separator 46 enters the second-stage heat exchanger 42 through the liquid inlet 414 of the second-stage heat exchanger 42.

Specifically, as shown in FIG. 1, a filter 71 and a second throttling device 702 are further provided between a liquid circulation pipeline of the gas-liquid separator 46 and a subsequent-stage heat exchanger, wherein the filter 71 can filter out impurities in the liquid refrigerant and prevent clogging of the refrigeration pipeline, causing the refrigeration system to fail to operate normally. The second throttling device 702 can be configured to throttle and reduce pressure and adjust flow rate.

In another example, a gas-liquid separator 46 is provided between the first stage heat exchanger and the (N−1)th-stage heat exchanger, and it is not necessary to provide a gas-liquid separator 46 between the Nth-stage heat exchanger and the (N−1)th-stage heat exchanger. Taking a five-stage heat exchange system as an example, a gas-liquid separator 46 is provided between every two adjacent heat exchangers 44 from the first-stage heat exchanger 41 to the fourth-stage heat exchanger. For example, a gas-liquid separator 46 is provided between the liquid outlet 412 of the first-stage heat exchanger 41 and the second gas inlet 411 of the second-stage heat exchanger 42, and a gas-liquid separator 46 is further provided between the liquid outlet 412 of the second-stage heat exchanger 42 and the second gas inlet 411 of the third-stage heat exchanger, the gas-liquid mixed refrigerant flowing out from the liquid outlet 412 of the first-stage heat exchanger 41 is separated by the gas-liquid separator 46, the separated gaseous refrigerant flows into the second-stage heat exchanger 42 from the second gas inlet 411 of the second-stage heat exchanger 42, the gaseous refrigerant releases heat in the heat exchanger, and the gaseous refrigerant with a higher boiling point in the mixed refrigerant is liquefied in the heat exchanger. The liquid refrigerant separated by the gas-liquid separator 46 enters the second-stage heat exchanger 42 through the liquid inlet 414 of the second-stage heat exchanger 42.

It is not necessary to provide a gas-liquid separator 46 between the liquid outlet 412 of the fourth-stage heat exchanger 44 and the second gas inlet 411 of the fifth-stage heat exchanger 45, and the fifth-stage heat exchanger 45 may include a bypass 47, one end of the bypass 47 is connected to the liquid inlet 414 of the fifth-stage heat exchanger 45, and the other end of the bypass 47 is connected to the liquid outlet 412 of the fifth-stage heat exchanger 45, the bypass 47 may be provided with a third throttling device 703.

After the refrigerant comes out of the liquid outlet 412 of the fifth-stage heat exchanger 45, a part of the refrigerant flows into the evaporator 80 through the inlet thereof, and the other part of the refrigerant enters the liquid inlet 414 of the fifth-stage heat exchanger 45 through the bypass 47. The third throttling device 703 can throttle and cool the refrigerant passing through the bypass 47, so the temperature of the refrigerant that flows into the liquid inlet 414 of the fifth-stage heat exchanger through the bypass 47 is lower than that of the refrigerant in the liquid outlet 412 of the fifth-stage heat exchanger 45, thereby realizing auto-cooling of the fifth-stage heat exchanger 45.

As shown in FIGS. 1, 2 and 3, the mixture of oil and high boiling point liquid refrigerant in the oil separator 20 can enter the second-stage heat exchanger 42 through the third oil outlet 25, so that the high boiling point refrigerant enters the refrigeration system and dissolves the refrigerant with a lower boiling point that has solidified in the system, preventing pipeline blockage, and can exert the refrigeration effect of the high boiling point refrigerant in the heat exchange device 40.

Specifically, the heat exchanger at each stage in the system uses a next-stage heat exchanger to cool the heat exchanger at the current stage, which can obtain a larger low temperature region to achieve auto-cascade refrigeration.

In some embodiments of the present application, as shown in FIGS. 1 and 2, the refrigeration system further includes: a first temperature sensor 481 and a second temperature sensor 482, wherein the first temperature sensor 481 is disposed at the gas outlet 413 of the Nth-stage heat exchanger, the second temperature sensor 482 is disposed at the outlet pipeline of the evaporator 80, and the scroll compressor 10 is a variable frequency scroll compressor; a control system that: when in a pre-cooling state, controls the first temperature sensor 481 to collect the temperature of refrigerant at the gas outlet 413 of the Nth-stage heat exchanger in real time, and reduces the operating frequency of the scroll compressor 10 when the temperature collected by the first temperature sensor 481 reaches a first preset temperature; and when in a refrigeration operating state, controls the second temperature sensor 482 to collect the temperature of the refrigerant output from the evaporator 80 in real time, and reduces the operating frequency of the scroll compressor 10 when the temperature collected by the second temperature sensor 482 reaches a second preset temperature.

In the embodiment of the present application, since the refrigerant continuously performs phase transition in the heat exchange device 40, it is necessary to monitor the temperature changes in the system in real time, wherein the first temperature sensor 481 is located on the gas outlet 413 of the Nth-stage heat exchanger, the temperature detected by the first temperature sensor 481 is the temperature of the refrigerant in the refrigeration system after N-stage heat exchange. The second temperature sensor 482 is located at the outlet of the evaporator 80, and the temperature detected is the temperature of the refrigerant after evaporation in the evaporator 80. Providing the first temperature sensor 481 and the second temperature sensor 482 in the refrigeration system is helpful for the personnel on duty to know the operation status of the refrigeration system in time, so as to control the opening and closing of the scroll compressor 10 or change the frequency of the scroll compressor 10.

In the embodiment of the present application, the scroll compressor 10 can be a variable frequency scroll compressor, in the refrigeration system, the scroll compressor 10 can change the refrigeration power by changing the frequency, and then change the refrigeration temperature according to actual needs, in order to meet different cooling requirements under working conditions.

Since the refrigeration system is relatively large, the entire refrigeration system needs to be cooled down to below −140° C. before performing refrigeration on external objects. Only when the internal temperature of the entire refrigeration system reaches −140° C., can the refrigeration system output refrigeration externally. The internal cooling process of the refrigeration system is the pre-cooling state. The external cooling process of the refrigeration system is the operating state.

Specifically, in the pre-cooling state, if a user does not provide external cooling output and remains the system in the pre-cooling state, the temperature in the refrigeration system will become lower and lower. However, a lower pre-cooling temperature does not necessarily leads to a better effect. Some refrigerants in the mixed refrigerant have a freezing point above −150° C., the low temperature inside the refrigeration system will cause the refrigerant to solidify and block the pipeline, causing abnormal refrigeration. In order to ensure the refrigeration process smoothly, it is necessary to set a first preset temperature in the control system, wherein the first preset temperature can be −140° C., when the temperature detected by the first temperature sensor 481 reaches the first preset temperature, the control system can control the scroll compressor 10 to reduce the frequency, the low pressure will increase accordingly, and the evaporation temperature will increase, thereby increasing the temperature in the refrigeration system to prevent the refrigerant from solidifying.

Taking the five-stage heat exchangers as an example, in a pre-cooling state, the first temperature sensor 481 can detect the temperature value at the gas outlet 413 of the fifth-stage heat exchanger 45 in real time, when the temperature detected by the first temperature sensor 481 reaches a first preset temperature, the control system can control the scroll compressor 10 to reduce the refrigeration power to prevent the internal temperature from being too low in a pre-cooling state, which otherwise causes the refrigerant to solidify and block the pipeline and thereby causes the refrigeration system to fail to perform normal cooling.

On the contrary, in the pre-cooling state, when the first temperature sensor 481 detects that the temperature at the gas outlet 413 in the Nth-stage heat exchanger is too high, the control system can control to increase the frequency of the compressor, and the internal temperature of the refrigeration system will decrease. The control system controls the standby temperature of the refrigeration system around a first preset temperature, which not only solves the problem of refrigerant solidification at low temperature, but also reduces energy consumption during the pre-cooling process of the refrigeration system.

Similarly, when the refrigeration system is in the operating state, the control system is provided with a second preset temperature, when the second temperature sensor 482 detects that the temperature at the outlet of the evaporator 80 reaches the second preset temperature, the control system can control the scroll compressor 10 to reduce the compression frequency, by controlling the operating frequency of the scroll compressor 10 to control the external cooling temperature of the refrigeration system, the energy consumption of the refrigeration system can be reduced.

In the embodiment of the present application, the refrigeration system further includes several pressure sensors. During the refrigeration process, since the refrigerant continuously performs phase transition in the heat exchange device 40, it is necessary to monitor the pressure changes in the system in real time.

The pressure sensor can sense the pressure signal in the system, the number of pressure sensors can be two, wherein the first pressure sensor 491 can be disposed at the liquid outlet 412 of the fourth-stage heat exchanger 44, and the second pressure sensor 492 can be disposed at the outlet of the evaporator 80.

The pressure sensor can be connected to the pressure gauge 493, so that the pressure at different locations in the system can be displayed more intuitively through the pressure gauge 493.

In some embodiments of the present application, as shown in FIGS. 1 and 2, the refrigeration system further includes a buffer tank 90, which is provided between the first-stage heat exchanger 41 and the (N−1)th stage heat exchanger.

In the embodiment of the present application, the buffer tank 90 is configured to buffer pressure fluctuation generated during the operation of the refrigeration system, so that the refrigeration system operates more smoothly.

When the refrigerant is exchanging heat in the heat exchanger, different refrigerants continuously perform phase transition, resulting in pressure fluctuations in the refrigeration system, which in turn causes the refrigeration system to be unstable. The buffer tank 90 is added to the heat exchanger, which can make the pressure within the refrigeration system more stable, thus ensuring the normal operation of the refrigeration process.

The above is only a preferred embodiment of the present application and is not intended to limit the scope of protection of the present application. Any modification, equivalent replacement, improvement, etc. made within the spirit and principles of this application shall be included in the scope of protection of this application.

What is claimed is:

1. A refrigeration system, which comprises: a scroll compressor (10), a first condenser (30), a second condenser (50) and a heat exchange device (40);

wherein the scroll compressor (10) comprises a housing (100), and a low pressure chamber (110), a high pressure chamber (120) and an oil pool (130) which are disposed in the housing (100); wherein the high pressure chamber (120) is connected to the oil pool (130);

the housing (100) is provided with a gas suction port (111), a liquid-spraying enthalpy increasing port (112), a first gas exhaust port (113) and a first oil outlet (114); wherein the first gas exhaust port (113) is configured to be connected to the first condenser (30) to convey condensed refrigerant to the heat exchange device (40), one end of the gas suction port (111) is connected to the scroll compressor (10), and the other end of the gas suction port (111) is connected to the heat exchange device (40), to absorb refrigerant that flows back after heat exchange by the heat exchange device (40);

the first oil outlet (114) is connected to an inlet of the second condenser (50), and an outlet of the second condenser (50) is connected to the liquid-spraying enthalpy increasing port (112), oil cooled by the second condenser (50) provides cooling for the scroll compressor (10);

wherein the refrigeration system further comprises an oil separator (20), which is provided between the first condenser (30) and the scroll compressor (10) and is provided with a first gas inlet (21), a first oil inlet (23), a second gas exhaust port (22), a second oil outlet (24) and a third oil outlet (25);

the first gas exhaust port (113) of the housing (100) is connected to the first condenser (30) through the oil separator (20), which is configured to receive gas of refrigerant mixed with oil discharged from the scroll compressor (10) through the first gas inlet (21);

the second gas exhaust port (22) of the oil separator (20) is connected to the first condenser (30), to discharge separated gas containing refrigerant to the first condenser (30), so that the first condenser (30) condenses the gas and conveys it to the heat exchange device (40) for heat exchange;

the first oil outlet (114) of the housing (100) is connected to the first oil inlet (23) of the oil separator (20), to maintain a stable liquid level in the oil pool (130);

the liquid-spraying enthalpy increasing port (112) of the housing (100) is connected to the second condenser (50) through the oil separator (20), and then connected to the second oil outlet (24) to cause oil in the oil separator (20) to flow back into the scroll compressor (10) through the liquid-spraying enthalpy increasing port (112), so as to cool the scroll compressor (10);

the third oil outlet (25) is configured to discharge excessive oil and gas of refrigerant in the oil separator (20) to convey them into the heat exchange device (40); a horizontal position of the third oil outlet (25) is higher than horizontal positions of the first oil inlet (23) and the second oil outlet (24) of the oil separator (20).

2. The refrigeration system according to claim 1, wherein a solenoid valve (60) is provided between the second oil outlet (24) and the liquid-spraying enthalpy increasing port (112), and is closed when the scroll compressor (10) stops operation.

3. The refrigeration system according to claim 1, wherein a float switch is provided in the oil separator (20); when a liquid level in the oil separator (20) is higher than that of the oil pool (130), the float switch opens the third oil outlet (25);

when the liquid level in the oil separator (20) is equal to or lower than that of the oil pool (130), the float switch closes the third oil outlet (25).

4. The refrigeration system according to claim 1, wherein the refrigeration system further comprises a throttling device (70) disposed between the third oil outlet (25) and a subsequent-stage heat exchanger, when a liquid level in the oil separator (20) is higher than that of the oil pool (130), a pressure difference between the oil separator (20) and the throttling device (70) causes the excessive oil and refrigerant to be discharged through the third oil outlet (25).

5. The refrigeration system according to claim 1, wherein the heat exchange device (40) comprises N-stage heat exchangers and an evaporator (80), N is greater than or equal to 2, and the N-stage heat exchangers are connected in series, and each of the N-stage heat exchangers comprises a liquid inlet (414), a second gas inlet (411), a gas outlet (413) and a liquid outlet (412), wherein the liquid inlet (414) and the gas outlet (413) are connected between heat exchangers at every two adjacent stages, and the liquid outlet (412) and the second gas inlet (411) are connected between the heat exchangers at every two adjacent stages through a gas-liquid separator (46), and the third oil outlet (25) is connected to a liquid inlet (414) of a second-stage heat exchanger (42) through a pipeline, a liquid outlet (412) of an Nth-stage heat exchanger is connected to an inlet of the evaporator (80), and an outlet of the evaporator (80) is connected to a liquid inlet (414) of an (N−1)th-stage heat exchanger.

6. The refrigeration system according to claim 2, wherein the heat exchange device (40) comprises N-stage heat exchangers and an evaporator (80), N is greater than or equal to 2, and the N-stage heat exchangers are connected in series, and each of the N-stage heat exchangers comprises a liquid inlet (414), a second gas inlet (411), a gas outlet (413) and a liquid outlet (412), wherein the liquid inlet (414) and the gas outlet (413) are connected between heat exchangers at every two adjacent stages, and the liquid outlet (412) and the second gas inlet (411) are connected between the heat exchangers at every two adjacent stages through a gas-liquid separator (46), and the third oil outlet (25) is connected to a liquid inlet (414) of a second-stage heat exchanger (42) through a pipeline, a liquid outlet (412) of an Nth-stage heat exchanger is connected to an inlet of the evaporator (80), and an outlet of the evaporator (80) is connected to a liquid inlet (414) of an (N−1)th-stage heat exchanger.

7. The refrigeration system according to claim 3, wherein the heat exchange device (40) comprises N-stage heat exchangers and an evaporator (80), N is greater than or equal to 2, and the N-stage heat exchangers are connected in series, and each of the N-stage heat exchangers comprises a liquid inlet (414), a second gas inlet (411), a gas outlet (413) and a liquid outlet (412), wherein the liquid inlet (414) and the gas outlet (413) are connected between heat exchangers at every two adjacent stages, and the liquid outlet (412) and the second gas inlet (411) are connected between the heat exchangers at every two adjacent stages through a gas-liquid separator (46), and the third oil outlet (25) is connected to a liquid inlet (414) of a second-stage heat exchanger (42) through a pipeline, a liquid outlet (412) of an Nth-stage heat exchanger is connected to an inlet of the evaporator (80), and an outlet of the evaporator (80) is connected to a liquid inlet (414) of an (N−1)th-stage heat exchanger.

8. The refrigeration system according to claim 4, wherein the heat exchange device (40) comprises N-stage heat exchangers and an evaporator (80), N is greater than or equal to 2, and the N-stage heat exchangers are connected in series, and each of the N-stage heat exchangers comprises a liquid inlet (414), a second gas inlet (411), a gas outlet (413) and a liquid outlet (412), wherein the liquid inlet (414) and the gas outlet (413) are connected between heat exchangers at every two adjacent stages, and the liquid outlet (412) and the second gas inlet (411) are connected between the heat exchangers at every two adjacent stages through a gas-liquid separator (46), and the third oil outlet (25) is connected to a liquid inlet (414) of a second-stage heat exchanger (42) through a pipeline, a liquid outlet (412) of an Nth-stage heat exchanger is connected to an inlet of the evaporator (80), and an outlet of the evaporator (80) is connected to a liquid inlet (414) of an (N−1)th-stage heat exchanger.

9. The refrigeration system according to claim 5, wherein the refrigeration system further comprises a first temperature sensor (481) and a second temperature sensor (482), and the first temperature sensor (481) is disposed at a gas outlet (413) of the Nth-stage heat exchanger; the second temperature sensor (482) is disposed at an outlet pipeline of the evaporator (80);

the scroll compressor (10) is a variable frequency scroll compressor (10);

the refrigeration system further comprises a control system that: when in a pre-cooling state, controls the first temperature sensor (481) to collect a temperature of refrigerant between a liquid inlet (414) and the gas outlet (413) in the Nth-stage heat exchanger in real time, and reduces an operating frequency of the scroll compressor (10) when the temperature collected by first temperature sensor (481) reaches a first preset temperature; and when in a refrigeration operating state, controls the second temperature sensor (482) to collect a temperature of refrigerant output from the evaporator (80) in real time, and reduces the operating frequency of the scroll compressor (10) when the temperature collected by the second temperature sensor (482) reaches a second preset temperature.

10. The refrigeration system according to claim 6, wherein the refrigeration system further comprises a first temperature sensor (481) and a second temperature sensor (482), and the first temperature sensor (481) is disposed at a gas outlet (413) of the Nth-stage heat exchanger; the second temperature sensor (482) is disposed at an outlet pipeline of the evaporator (80);

the scroll compressor (10) is a variable frequency scroll compressor (10);

the refrigeration system further comprises a control system that: when in a pre-cooling state, controls the first temperature sensor (481) to collect a temperature of refrigerant between a liquid inlet (414) and the gas outlet (413) in the Nth-stage heat exchanger in real time, and reduces an operating frequency of the scroll compressor (10) when the temperature collected by first temperature sensor (481) reaches a first preset temperature; and when in a refrigeration operating state, controls the second temperature sensor (482) to collect a temperature of refrigerant output from the evaporator (80) in real time, and reduces the operating frequency of the scroll compressor (10) when the temperature collected by the second temperature sensor (482) reaches a second preset temperature.

11. The refrigeration system according to claim 7, wherein the refrigeration system further comprises a first temperature sensor (481) and a second temperature sensor (482), and the first temperature sensor (481) is disposed at a gas outlet (413) of the Nth-stage heat exchanger; the second temperature sensor (482) is disposed at an outlet pipeline of the evaporator (80);

the scroll compressor (10) is a variable frequency scroll compressor (10);

the refrigeration system further comprises a control system that: when in a pre-cooling state, controls the first temperature sensor (481) to collect a temperature of refrigerant between a liquid inlet (414) and the gas outlet (413) in the Nth-stage heat exchanger in real time, and reduces an operating frequency of the scroll compressor (10) when the temperature collected by first temperature sensor (481) reaches a first preset temperature; and when in a refrigeration operating state, controls the second temperature sensor (482) to collect a temperature of refrigerant output from the evaporator (80) in real time, and reduces the operating frequency of the scroll compressor (10) when the temperature collected by the second temperature sensor (482) reaches a second preset temperature.

12. The refrigeration system according to claim 8, wherein the refrigeration system further comprises a first temperature sensor (481) and a second temperature sensor (482), and the first temperature sensor (481) is disposed at a gas outlet (413) of the Nth-stage heat exchanger; the second temperature sensor (482) is disposed at an outlet pipeline of the evaporator (80);

the scroll compressor (10) is a variable frequency scroll compressor (10);

the refrigeration system further comprises a control system that: when in a pre-cooling state, controls the first temperature sensor (481) to collect a temperature of refrigerant between a liquid inlet (414) and the gas outlet (413) in the Nth-stage heat exchanger in real time, and reduces an operating frequency of the scroll compressor (10) when the temperature collected by first temperature sensor (481) reaches a first preset temperature; and when in a refrigeration operating state, controls the second temperature sensor (482) to collect a temperature of refrigerant output from the evaporator (80) in real time, and reduces the operating frequency of the scroll compressor (10) when the temperature collected by the second temperature sensor (482) reaches a second preset temperature.

* * * * *